US006318281B2

(12) United States Patent
Hillenbrand et al.

(10) Patent No.: US 6,318,281 B2
(45) Date of Patent: Nov. 20, 2001

(54) SEWING NEEDLE FOR MULTI-DIRECTIONAL SEWING

(75) Inventors: Bernd Hillenbrand; Gerd Horn, both of Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 09/790,797

(22) Filed: Feb. 23, 2001

(30) Foreign Application Priority Data

Feb. 23, 2000 (DE) ..... 100 08 447

(51) Int. Cl.[7] ..... D05B 85/02
(52) U.S. Cl. ..... 112/222
(58) Field of Search ..... 112/222, 224; 163/1, 5

(56) References Cited

U.S. PATENT DOCUMENTS 357,805 * 2/1887 Willcox ..... 112/222
1,323,340 * 12/1919 Weis ..... 112/222
2,221,419 * 11/1940 Antcliff ..... 112/224
3,322,085 * 5/1967 Weiss ..... 112/222

* cited by examiner

*Primary Examiner*—Ismael Izaguirre
(74) *Attorney, Agent, or Firm*—Venable; Gabor J. Kelemen

(57) ABSTRACT

A sewing machine needle includes a blade; a shank extending from one blade end and adapted to be clamped in a sewing machine; a needle point provided at the other blade end; an elevation provided on the blade adjacent the needle point; and an eye traversing the blade adjacent the needle point. The eye has a first eye end oriented toward the shank; a second eye end oriented toward the said point; a thread inlet side; and a thread outlet side. The elevation is situated on the thread outlet side between the needle point and the second eye end. The eye is bordered by two facing eye walls each having a respective edge at the thread outlet side. Each edge extends from the first eye end to the second eye end such that it is recessed from an imaginary straight line connecting the first eye end with the elevation.

12 Claims, 4 Drawing Sheets

SEWING NEEDLE FOR MULTI-DIRECTIONAL SEWING

CROSS REFERENCE TO RELATED APPLICATION

This application claims the priority of German Application No. 100 08 447.8 filed Feb. 23, 2000, which is incorporated herein by reference.

BACKGROUND OF THE INVENTION

This invention relates to a sewing machine needle.

Generally, sewing machines have a needle which, in the vicinity of its point, has an eye through which an upper thread is guided. During sewing, the needle pierces through the material to be sewn (flat textile fabric) and, as a result of a stepwise feed of the fabric, the needle produces spaced stitch holes. The upper thread is guided from stitch hole to stitch hole, and during this occurrence the thread glides over an edge of the eye both in the forward and in the reverse direction. When the feed direction of the fabric is determined, the needle has a fixed working direction and the fabric is advanced in a fixed direction which, as a rule, is oriented transversely to the eye.

It has been found, however, that in sewing machines which provide for a fabric feed in different directions, for example, in forward and rearward directions or in several other directions, the seam quality depends from the sewing direction and/or the thread twist. Such a dependence is often not desirable.

German Utility Model 86 32 106.4 discloses a tufting needle which has, in the direction of the needle axis, an elongated eye provided at both ends with respective curved upper and lower eye edges. At the outlet side the eye edge is straight. The tufting needle is of asymmetrical construction as seen in top plan view, that is, in the direction of the eye axis. On the outlet side the eye adjoins a curved thread trough. A tufting needle of this type has a preferred working direction.

In contrast, U.S. Pat. No. 3,986,468 discloses a symmetrical needle for a sewing machine. In the vicinity of its point, the needle has an eye extending transversely through the needle body and bounded by two eye walls. Both eye walls have straight edges at their upper as well as at their lower sides, that is, the edges of the side walls extend in each instance along a straight line from the eye end oriented toward the needle shank (clamping portion) to the eye end oriented toward the needle point. Although such needles are of symmetrical construction, they have a different behavior for a forward sewing and a reverse sewing with twisted threads.

SUMMARY OF THE INVENTION

It is an object of the invention to provide an improved sewing machine needle of the above-outlined type which reduces quality differences between seams made in different sewing directions.

This object and others to become apparent as the specification progresses, are accomplished by the invention, according to which, briefly stated, the sewing machine needle includes a blade; a shank extending from one blade end and adapted to be clamped in a sewing machine; a needle point provided at the other blade end; an elevation provided on the blade adjacent the needle point; and an eye traversing the blade adjacent the needle point. The eye has a first eye end oriented toward the shank; a second eye end oriented toward the said point; a thread inlet side; and a thread outlet side. The elevation is situated on the thread outlet side between the needle point and the second eye end. The eye is bordered by two facing eye walls each having a respective edge at the thread outlet side. Each edge extends from the first eye end to the second eye end such that it is recessed from an imaginary straight line connecting the second eye end with the elevation.

The needle according to the invention has an eye which extends transversely through the needle body. By "transversely" there is meant a perpendicular orientation of the eye to the longitudinal central axis of the needle body or an inclined orientation at an obtuse angle thereto. The needle eye is bounded by two eye walls which are recessed at the outlet side of the eye, that is, at the side from which the thread extends to the fabric. Stated differently, the eye wall edges are curving towards the needle back or are otherwise shaped. The eye walls which may continue as side walls of a thread outlet trough, extend thus between two locations which, with respect to the needle thickness, each have a local elevation. In this manner the recessed eye walls make possible for a twisted thread to run transversely to the eye, laterally over the eye wall without appreciably changing the twist of the thread as it runs over the eye wall. By virtue of the diminished interference with the thread twist a basic condition is provided for the purpose that in the different sewing directions the seams have at least approximately the same quality. Thus, for example, the thread has no appreciably different twist as it traverses the eye walls irrespective of whether forward or reverse sewing is performed.

By recessing the contour in the region of the eye below an imaginary connecting line between the shank-side eye end and an adjoining, needle point-side elevation, the friction between the thread and the edge of the eye wall is reduced. The reduction of the friction thus has a lesser effect on the thread, independently from the angle which is formed between the thread and the needle. Accordingly, the thread will be less twisted or untwisted and thus an improved seam formation and an improved quality of the sewn fabric are ensured. Further, effects appearing in extreme cases in conventional needles are avoided. If, during sewing, the twist of a twisted thread is excessively affected, the loop formation may be adversely influenced. In case a thread is untwisted or additionally twisted and is, in such a condition, pulled through the fabric, upon withdrawing the needle it may turn or curl without forming a required, regular loop. Such an occurrence results in defective stitches and may also lead to thread breakage. By virtue of the new needle contour according to the invention, such extreme defects may be avoided. This applies particularly to multidirectional sewing in which the fabric may be automatically advanced in all (but at least, in two) directions.

The effect of the lesser influence of the thread twist in a needle according to the invention may also have significance in sewing machines which sew merely in a single direction. The needle according to the invention permits the use of upper threads having different twists, for example, right-hand twists or left-hand twists, wherein the effect of the twist direction has a significantly reduced effect on the seam quality and becomes insignificant in most cases.

The eye walls are preferably of stepless course, and the outlet side of the eye is concavely curved. Such a curved construction of the upper edges of the eye walls at the outlet side supports the above-noted uniform thread run independently from the sewing direction and furthermore, it permits a high sewing speed because of the overall reduced eye height which results in a slow opening of the stitch hole.

In a preferred embodiment of the invention a thread trough is provided which adjoins the outlet end of the eye and which extends in the direction of the needle point. The eye walls continue as the side walls of the thread trough. In this manner a very satisfactory thread guidance is achieved and, in particular, a good support of the thread during loop formation is obtained. Loop formation occurs at the moment the needle has pulled the thread through the fabric and begins, or is in the process of performing, its reverse stroke.

A concave, arcuate curvature of the side walls makes possible a general rounding of the side wall edge or its flattening transversely to the orientation of the needle eye. In either case, the thread may run substantially undisturbed over the respective edge and the angle which the individual strands or filaments of the thread form with the eye wall is of subordinated significance. This applies particularly to a construction having a flattened edge.

According to an advantageous embodiment of the invention, the thread trough at the outlet side of the needle eye is oriented parallel to the longitudinal direction of the needle. As a result, the needle has no preferred working direction predetermined by the thread trough; this feature favors a multidirectional use of the needle.

Further, the needle is preferably of symmetrical construction in relation to a longitudinal central plane. Both eye walls are in such construction formed in mirror symmetry to one another. This construction too, favors the multidirectional working capability of the sewing needle.

Adjacent the eye the needle blade preferably has a depression which ensures sufficient space for the thread gripper during sewing. In a preferred embodiment, the blade is throughout flattened in the region between the needle point and the depression, and has its maximum blade height at the eye preferably only between the eye and the depression. This arrangement has the advantage as concerns the opening of the stitch hole and the run of the thread in case of different working directions.

It has been found that a recessing of the contour of the eye walls is particularly effective if the distance of the lowest point of the recessed portion to the central needle axis is approximately 25% of the nominal blade diameter.

The needle eye may additionally be flattened on the thread inlet side for additional effects. It has been found to be expedient, however, to provide for a linear transition of the thread through rims from the thread inlet trough to the needle eye. Such a construction results in a very satisfactory protection of the thread at the inlet side of the eye.

DESCRIPTION OF A PREFERRED EMBODIMENTS

Figure 1:
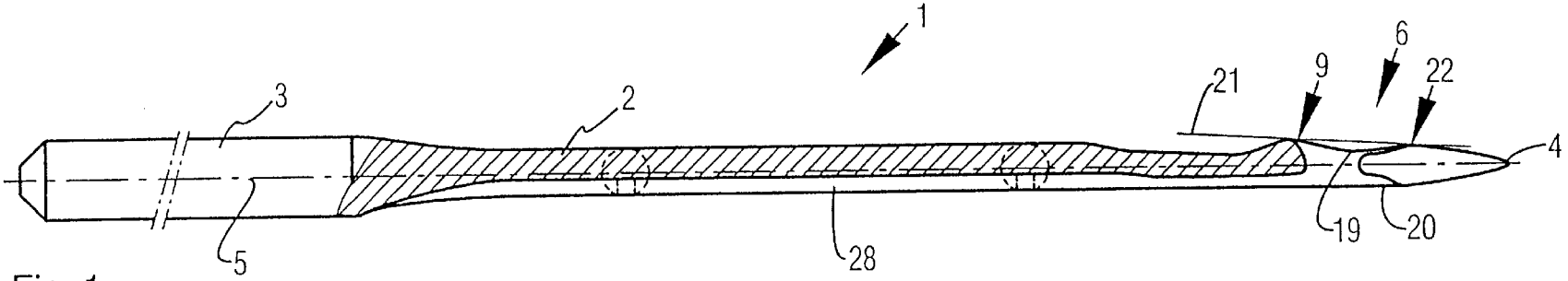
FIG. 1 is an axial sectional side elevational view of a preferred embodiment of the invention.

FIG. 1 shows a needle 1 whose blade 2 (needle body) extends from a shank portion (portion to be clamped) 3 to a needle point 4 along a longitudinal central axis 5. The blade 2 is preferably of linear configuration but may be of curved shape if required. The position of the longitudinal axis 5 is determined by the point 4 and coincides with the length dimension of the blade 2.

Figure 3:
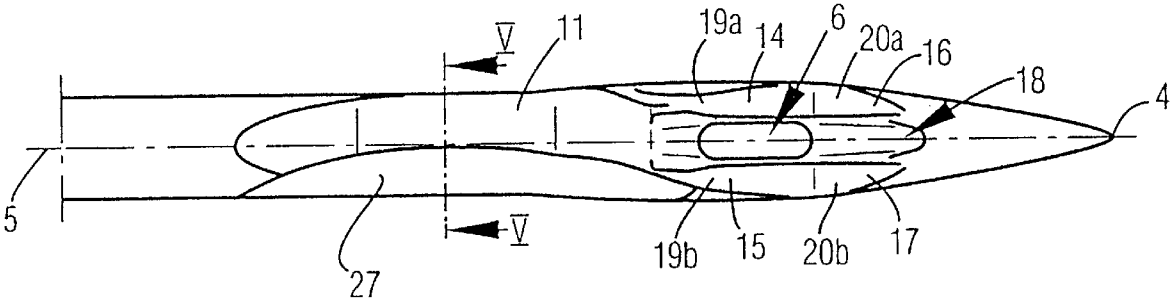
FIG. 3 is a top plan view of the structure shown in FIG. 2.

In the vicinity of the point 4 the blade 2 is provided with an eye 6 which traverses the blade 2. The eye 6, as shown in FIG. 3, is an elongated or oval aperture or may have a circular or other shape. The aperture which forms the eye 6, has a non-illustrated central axis or aperture axis which preferably intersects the longitudinal central axis 5 and which is oriented perpendicularly or at an acute angle thereto. In any event, the eye 6 extends transversely through the blade 2.

The eye 6, as related to the longitudinal needle direction (determined by the longitudinal central axis 5), is bounded by a first eye end 7 on the side opposite from the needle point 4 (that is, on that side which is oriented toward the needle shank 3) and by a second eye end 8 on the side oriented towards the needle point 4. Both eye ends 7 and 8 are preferably rounded and formed without sharp edges. At the eye end 7 the blade 2 of the needle 1 attains at a location 9 (FIG. 2) a height above the needle back 10 which is approximately 87% of the nominal needle diameter. The height at the location 9 defines a maximum elevation, that is, the greatest blade thickness between the needle point 4 and a depression 11 which adjoins the location 9. In other embodiments the height of the blade 2 at the location 9 may be determined in a different manner.

Also referring to FIG. 3, eye walls 14, 15 are provided in a mirror image symmetry to one another between the location 9 and the second eye end 8. Between the second eye end 8 and the needle point 4 the eye walls 14, 15 continue as side walls 16, 17 of an outlet-side thread guiding trough 18 which extends parallel to the longitudinal blade axis 5.

Figure 2:
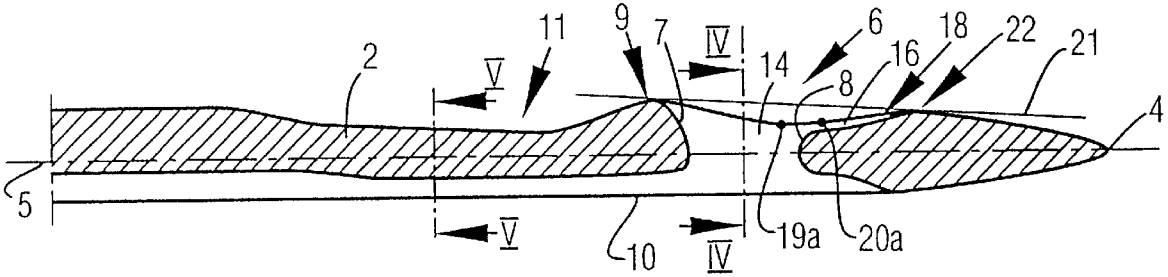
FIG. 2 is an axial sectional side elevational view of the frontal end portion of the needle of FIG. 1, shown on an enlarged scale.

As it may be observed particularly in FIGS. 2 and 3, the eye walls 14, 15 and the side walls 16, 17 have respective upper edges 19*a*, 19*b*, 20*a*, 20*b* which define the contour of the eye 6 at the outlet side. The edges 19*a*, 20*a*, 19*b*, 20*b* form a closed, saddle-shaped annular surface. The contour defined by the edges 19, 20 and viewed transversely to the eye 6, does not touch an imaginary line 21 which connects the location 9 with a location 22 at which the thread trough 18 terminates. The imaginary line 21 forms preferably a positive acute angle with the longitudinal central axis 5. In the shown example, the angle is approximately 5°. The edges 19 and 20 which merge into one another without a projection, step or kink define preferably an arc which in its middle region approaches the longitudinal axis 5. The closest approach to the longitudinal axis 5 is preferably approximately in the vicinity of the second eye end 8. At this location the distance to the longitudinal axis 5 is preferably only 25% or less of the nominal diameter of the needle blade 2.

The thread trough 18 is relatively flat in the described embodiment. Such construction means that the side walls 16, 17 are significantly shallower than the width of the eye 6. The height of the side walls 16, 17 is thus preferably significantly less than the thickness of the thickest thread which may be passed through the eye 6.

Figure 4:
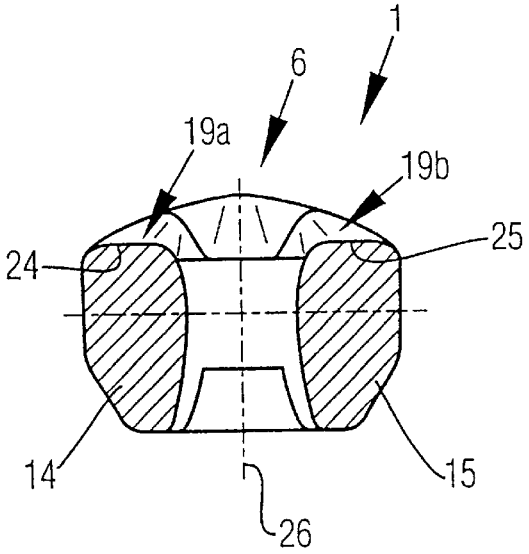
FIG. 4 is a sectional view taken along IV—IV of FIG. 2, illustrated on an enlarged scale.

As may be seen particularly in FIG. 4, the eye walls 14, 15 have, on the upper side shown in FIGS. 1, 2 and 4, that is, at the thread outlet side, glide surfaces 24, 25 which are defined by the edges 19*a*, 19*b* and which are at least in part linear in a direction transverse to the opening direction 26 of the eye 6. The glide surfaces 24, 25 are rounded at the respective transitions to the inner wall of the eye 6 and the outer side of the needle 1.

Figure 5:
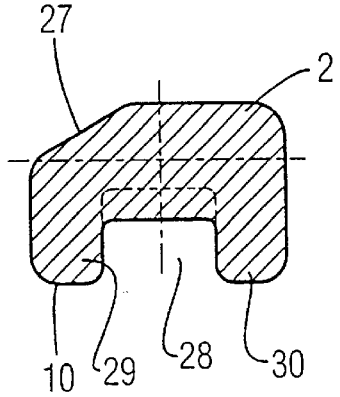
FIG. 5 is a sectional view taken along line V—V of FIG. 2 or 3, illustrated on an enlarged scale.

The needle 1 is preferably of symmetrical construction from the needle point 4 to the eye 6. In its further course, however, it may deviate from such symmetry as may be observed particularly in FIGS. 3 and 5. In the region of the depression 11 a lateral chamfer 27 may be provided to ensure sufficient space for a loop gripper.

Preferably, a thread inlet trough 28 is provided in the needle back 10, that is, on that side of the needle blade which is opposite the depression 11. The trough 28 extends up to or beyond the eye 6 and is preferably bounded by straight-edged side walls 29, 30. The height of the side walls 29, 30 is so dimensioned that a thread running to the eye 6 is received entirely by the thread inlet trough 28 or projects only slightly therefrom. As shown in FIG. 1, the thread inlet trough 28 may also have a stepped height where the depth or height of the thread inlet trough 28 decreases towards the eye 6.

In the description which follows, the operation of the above-described needle 1 will be set forth.

Figure 6A:
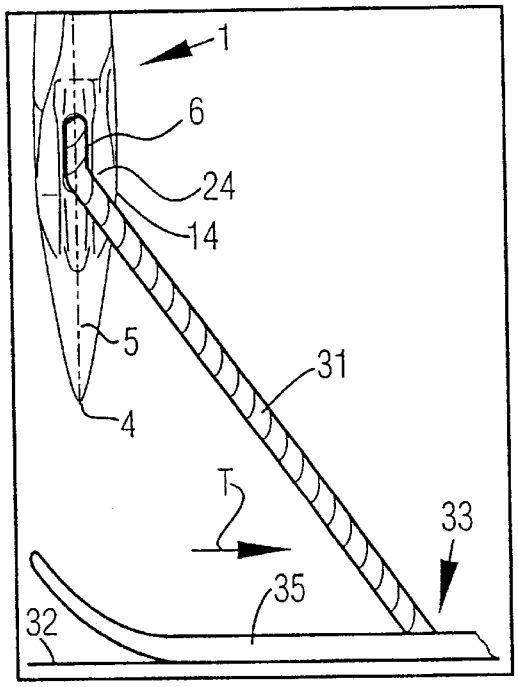
FIGS. 6*a*–6*d* are schematic sequential illustrations of different phases of the fabric piercing operation during forward sewing performed by a needle according FIG. 7.

First, reference is made to FIGS. 6*a*–6*d* which show the needle 1 in various phases during a sewing operation in the forward direction. In FIG. 6*a*, the needle 1 is situated above a hold-down member 35 which lies on a textile fabric 32 to be sewn by a thread 31. The thread 31 is tensioned from a location 33 which is defined by the last stitch hole and the last stitch knotting, to the eye 6 of the needle 1 which moves towards the fabric 32 while the thread 31 is held taut. The thread 31 has a left-hand twist (z-twisted) as shown in FIGS. 6*a*–6*d*. The thread 31 lies on the glide surface 24 and the individual filaments or strands of the thread 31 run over the edges of the glide surface 24 approximately transversely to the longitudinal axis 5. An interference with the twist is thus even initially relatively slight.

Figure 6B:
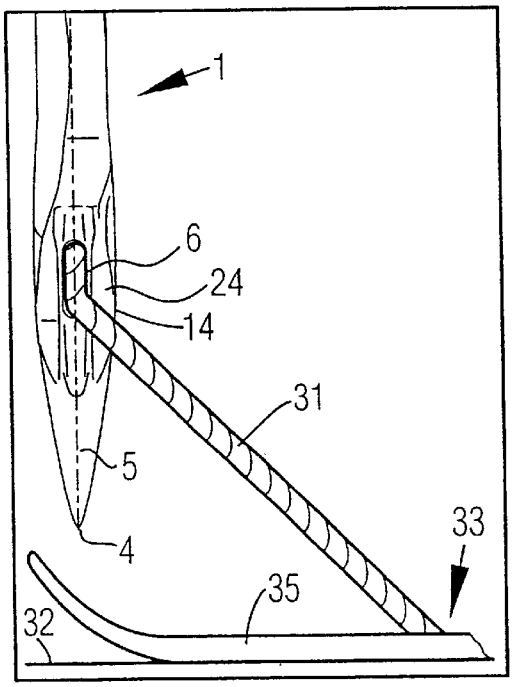
Figure 6C:
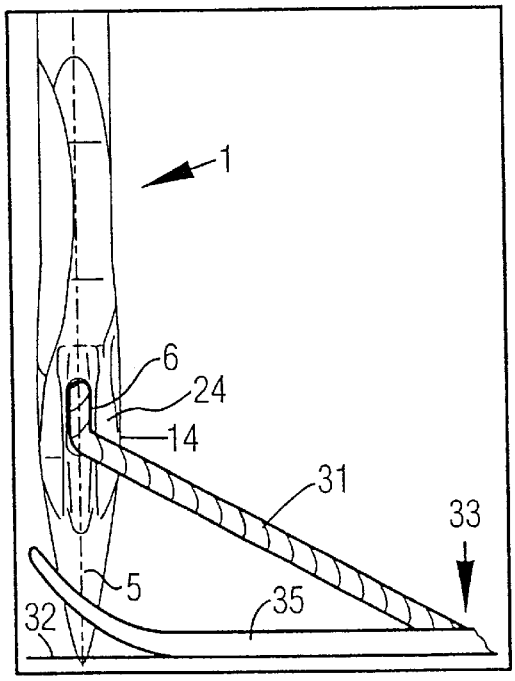
Figure 6D:
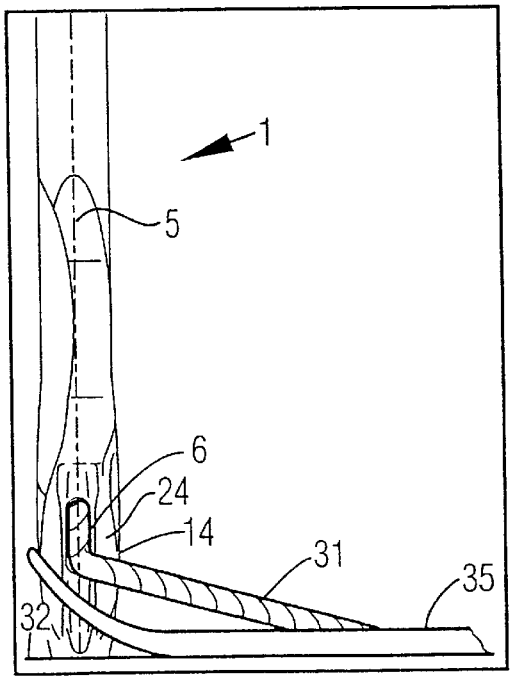
Figure 7A:
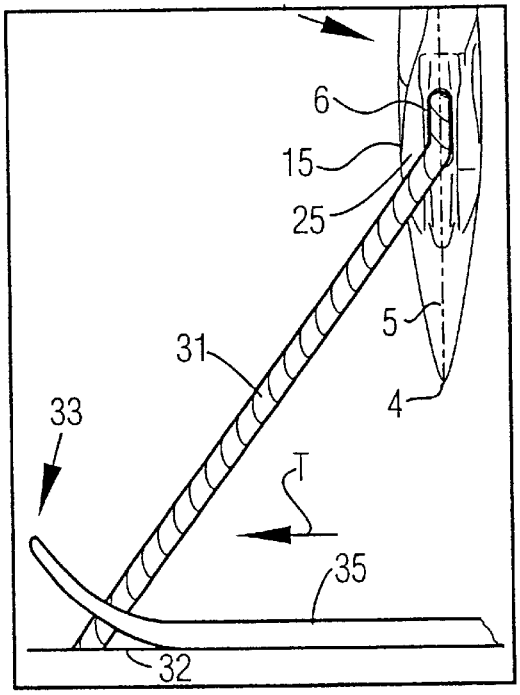
FIGS. 7*a*–7*d* are schematic sequential illustrations of different phases of the fabric piercing operation during sewing in the reverse direction performed by a needle according FIG. 7.
Figure 7B:
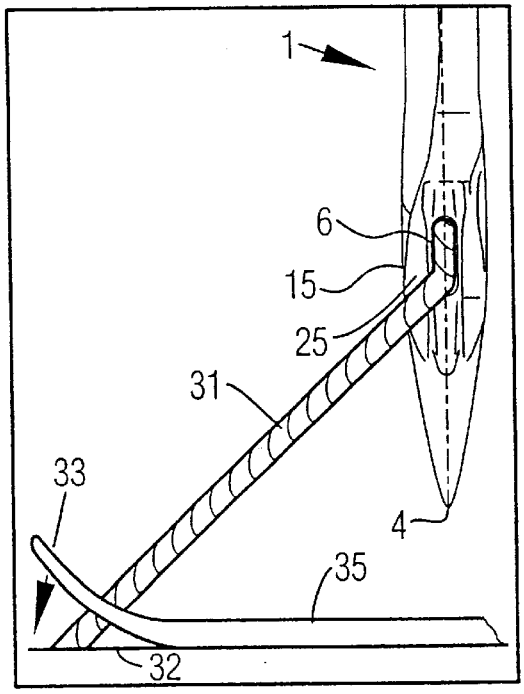
Figure 7C:
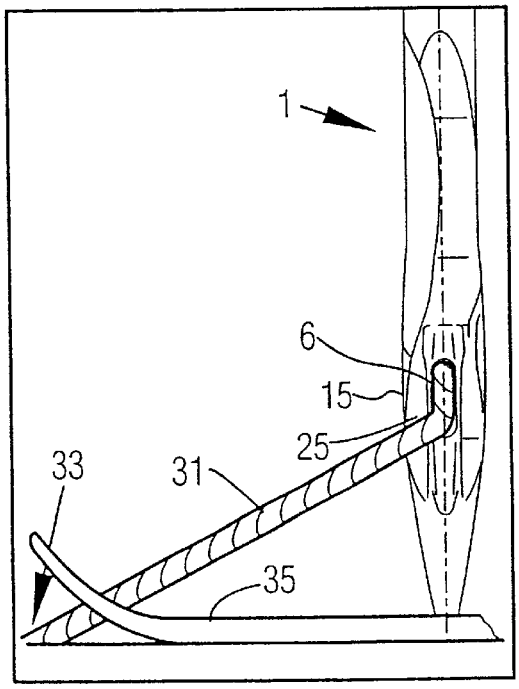
Figure 7D:
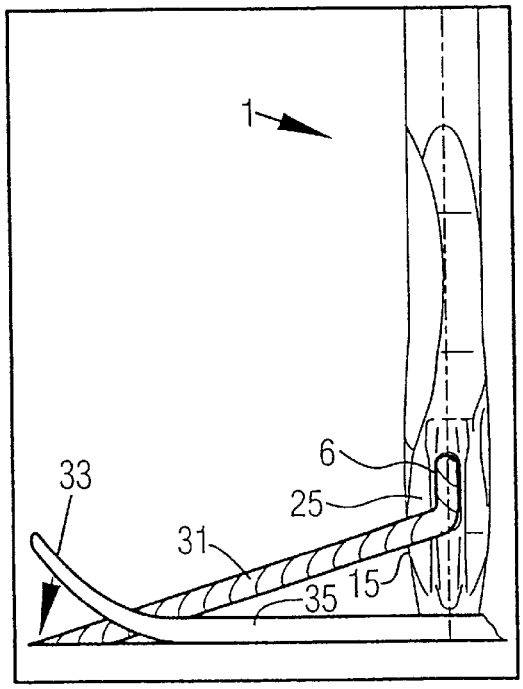

During the penetrating motion of the needle, as shown in FIGS. 6*b* and 6*c*, the thread 31 is pulled through the eye 6 to the extent as the distance between the location 33 and the eye 6 decreases. By virtue of the recessed eye wall 14 and the flat or slightly rounded configuration of the glide surface 24, this step may proceed without an additional twist and twisted feed of the thread 31. This is illustrated in FIGS. 6*a*–6*d* by the relatively constant pitch of the twist. While the conditions during sewing in the reverse direction are essentially different, the thread twist in such a case too, remains substantially unchanged, as illustrated in FIGS. 7*a*–7*d*. Again, a thread 31 is used which has the same twist as the thread 31 used for the forward sewing. The textile fabric, however, is moved towards the left relative to the needle 1, rather than towards the right as shown in FIGS. 6*a*–6*d*. The direction of fabric motion is designated at T in FIGS. 6*a* and 7*a*. The location 33 having the last stitch knotting is thus moved away from the needle 1 in such as manner that the thread 31 runs over the eye wall 15 and the glide surface 25. The thread twist is such that the individual filaments or strands of the thread 31 run over the glide surface 25 and its edges in an orientation parallel or at an acute angle to the longitudinal blade axis 5. By virtue of the flattened configuration of the glide surface 25 and its rounded edges the eye wall 15, however, does not interfere with the twist of the thread 31 and thus leaves it unchanged. In particular, the twist, upon pulling the thread taut, is not pushed together, so that the thread 31 is not twisted additionally. In this manner, during the forward sewing as well as during the reverse sewing equal or at least approximately equal seam qualities are obtained. Further, the seam quality is independent from the twist direction of the thread 31 both in the forward and in the reverse sewing. Also, even in case of lateral motions of the textile fabric 32 the seams will have the same or at least approximately the same quality.

In recapitulation, the needle 1 according to the invention is designed for sewing machines which are capable of sewing in at least two (but preferably more) directions. For this purpose, the needle 1 has a new geometry: in the region of the eye, on the blade side which contains the depression 11 the needle 1 has, in the direction of the needle point 4, a bilaterally recessed edge of the eye or the trough edge of the outlet guide trough. The full blade height at the eye is attained only in the region between the end of the depression 11 and the beginning of the eye 6. The depth of the recession depends from the needle thickness and may be determined according to requirements. The lengths of the lowered eye edges and/or trough edges are dependent from the geometry of the needle. The length of the eye edges is preferably so selected that the outlet of the straight outlet trough is preserved.

It will be understood that the above description of the present invention is susceptible to various modifications, changes and adaptations, and the same are intended to be comprehended within the meaning and range of equivalents of the appended claims.

What is claimed is:

1. A sewing machine needle comprising:

(a) a blade having first and second ends;

(b) a shank extending from said first end of said blade and adapted to be clamped in a sewing machine;

(c) a point provided at said second end of said blade;

(d) an elevation provided on said blade adjacent said point;

(e) an eye traversing said blade adjacent said point; said eye having (1) a first eye end oriented toward said shank;

(2) a second eye end oriented toward said point;

(3) a thread inlet side;

(4) a thread outlet side; said elevation being situated on said thread outlet side between said point and said first eye end; and (5) two facing eye walls bounding said eye and each having a respective edge at said thread outlet side; each said edge extending from said first eye end to said second eye end recessed from an imaginary straight line connecting said first eye end with said elevation; and (f) a thread trough provided in said blade and extending from said thread outlet side of said eye toward said point; said thread trough having facing side walls constituting respective continuations of said eye walls.

2. The sewing machine needle as defined in claim 1, wherein said edges are concavely curved.

3. The sewing machine needle as defined in claim 1, wherein said facing side walls of said thread trough have respective edges; said edges of said eye walls and said edges of said side walls have an arcuate curvature.

4. The sewing machine needle as defined in claim 1, wherein said needle has a longitudinal direction and further wherein said thread trough is oriented parallel to said longitudinal direction.

5. The sewing machine needle as defined in claim 1, wherein said eye walls are symmetrical to one another relative to a longitudinal central plane passing through said inlet and outlet sides of said eye.

6. The sewing machine needle as defined in claim 1, wherein said needle has a longitudinal direction and further wherein said eye walls are flattened in a direction, transverse to said longitudinal direction of said outlet side of said eye.

7. The sewing machine needle as defined in claim 1, wherein said eye walls have rounded edges at said outlet side of said eye.

8. The sewing machine needle as defined in claim 1, further comprising a depression provided in said blade on said outlet side of said eye; wherein said depression adjoins said eye and extends toward said shank and further wherein said blade has a thickness between said depression and said point which is 80–90% of a nominal height of said blade solely between said eye and said depression.

9. The sewing machine needle as defined in claim 1, further comprising a depression provided in said blade on said outlet side of said eye; wherein said depression adjoins said eye and extends toward said shank and further wherein said blade has a thickness between said depression and said point which is 87% of a nominal height of said blade solely between said eye and said depression.

10. The sewing machine needle as defined in claim 1, wherein said blade has a longitudinal central axis; wherein said edges of said eye walls have at least at one location a closest distance from said axis and further wherein said closest distance is about 25% of a nominal height of said blade.

11. The sewing machine needle as defined in claim 1, further comprising a thread inlet trough provided in said blade on said inlet side of said eye and extending from said first eye end toward said shank; said thread inlet trough having side walls; wherein said eye walls have straight bordering edges on said inlet side of said eye and further wherein said straight bordering edges of said eye walls are respective continuations of said side walls of said thread inlet trough.

12. The sewing machine needle as defined in claim 11, wherein said continuations are linear.

* * * * *